US011417485B2

(12) United States Patent
Yoo

(10) Patent No.: US 11,417,485 B2
(45) Date of Patent: Aug. 16, 2022

(54) DC RELAY HAVING AUXILIARY CONTACT

(71) Applicant: LSIS CO., LTD., Anyang-si (KR)

(72) Inventor: Jungwoo Yoo, Anyang-si (KR)

(73) Assignee: LS ELECTRIC CO., LTD.

( * ) Notice: Subject to any disclaimer, the term of this patent is extended or adjusted under 35 U.S.C. 154(b) by 464 days.

(21) Appl. No.: 16/248,034

(22) Filed: Jan. 15, 2019

(65) Prior Publication Data

US 2019/0228938 A1 Jul. 25, 2019

(30) Foreign Application Priority Data

Jan. 22, 2018 (KR) ..... 10-2018-0007938

(51) Int. Cl.

| | |
|---|---|
| ***H01H 50/54*** | (2006.01) |
| ***H01H 50/58*** | (2006.01) |
| ***H01H 50/60*** | (2006.01) |
| ***H01H 50/14*** | (2006.01) |
| ***H01H 50/62*** | (2006.01) |

(52) U.S. Cl.

CPC ..... *H01H 50/541* (2013.01); *H01H 50/14* (2013.01); *H01H 50/546* (2013.01); *H01H 50/58* (2013.01); *H01H 50/60* (2013.01); *H01H 50/62* (2013.01)

(58) Field of Classification Search

CPC ..... H01H 50/00; H01H 50/14; H01H 50/541; H01H 50/546; H01H 50/58; H01H 50/60; H01H 50/62

USPC ..... 335/2

See application file for complete search history.

(56) References Cited

U.S. PATENT DOCUMENTS

2010/0127805 A1* 5/2010 Bollinger ..... H01H 50/045 335/131
2012/0307409 A1* 12/2012 Wan ..... H01H 50/326 361/59
2013/0335174 A1* 12/2013 Kodama ..... H01H 50/541 335/2

(Continued)

FOREIGN PATENT DOCUMENTS

CN 104246956 A 12/2014
CN 206301743 U 7/2017

(Continued)

OTHER PUBLICATIONS

Japanese Office Action for related Japanese Application No. 2019-006181; action dated Jan. 31, 2020; (4 pages).

(Continued)

*Primary Examiner* — Shawki S Ismail
*Assistant Examiner* — Lisa N Homza
(74) *Attorney, Agent, or Firm* — K&L Gates LLP

(57) ABSTRACT

The present disclosure relates to a direct current (DC) relay having an auxiliary contact, and more particularly, to a DC relay having an auxiliary contact to have a monitoring function regarding a state of the DC relay. The DC relay having an auxiliary contact includes a housing, main contacts installed at a portion of the housing, and an auxiliary contact installed at another portion of the housing, wherein a partition is installed in a longitudinal direction inside the housing to provide a first accommodating part and a second accommodating part, the main contacts are installed in the first accommodating part, and the auxiliary contact is installed in the second accommodating part.

8 Claims, 10 Drawing Sheets

(56) References Cited

U.S. PATENT DOCUMENTS

| | | | | |
|---|---|---|---|---|
| 2014/0002092 | A1* | 1/2014 | Kodama | G01R 31/3278 324/418 |
| 2015/0015350 | A1* | 1/2015 | Tachikawa | H01H 50/18 335/131 |

FOREIGN PATENT DOCUMENTS

| | | | |
|---|---|---|---|
| EP | 2889891 | A1 | 7/2015 |
| EP | 3258476 | A1 | 12/2017 |
| JP | 58099748 | U | 7/1983 |
| JP | H02253531 | A | 10/1990 |
| JP | 2012014988 | A | 1/2012 |
| JP | 2013232341 | A | 11/2013 |
| JP | 2014102908 | A | 6/2014 |
| WO | 2013161207 | A1 | 10/2013 |
| WO | 2017217045 | A1 | 12/2017 |

OTHER PUBLICATIONS

Notice of Allowance issued in the corresponding Japanese Patent Application No. 2019-006181—3 Pages.
Japanese Office Action for related Japanese Application No. 2019-006181; action dated Jul. 21, 2020; (4 pages).
Chinese Office Action for related Chinese Application No. 201910058274.9; action dated Jun. 1, 2020; (8 pages).
European Search Report for related European Application No. 19152393.5; action dated Apr. 2, 2019; (7 pages).

* cited by examiner

DC RELAY HAVING AUXILIARY CONTACT

CROSS-REFERENCE TO RELATED APPLICATION

Pursuant to 35 U.S.C. § 119(a), this application claims the benefit of earlier filing date and right of priority to Korean Application No. 10-2018-0007938, filed on Jan. 22, 2018, the contents of which is incorporated by reference herein in its entirety.

BACKGROUND OF THE INVENTION

1. Field of the Invention

The present disclosure relates to a direct current (DC) relay having an auxiliary contact, and more particularly, to a DC relay having an auxiliary contact to have a monitoring function regarding a state of the DC relay.

2. Background of the Invention

Generally, a DC relay or a magnetic switch is a type of an electrical circuit switching device that transmits mechanical driving and current signals using the principle of an electromagnet, and is installed in various industrial facilities, machines, vehicles, and the like.

In particular, an electric vehicle such as a hybrid vehicle, a fuel cell vehicle, a golf cart, and an electric forklift has an electric vehicle relay for supplying and blocking electric power of a battery to a power generating device and an electric device part, and the electric vehicle relay is one of the key components of an electric vehicle.

FIGS. 1 and 2 are a perspective view and an internal structural view of a DC relay according to the related art.

The DC relay includes a contact part and an arc extinguishing part installed at an upper portion of a plate 1 provided inside a case (not shown) and an actuator installed at a lower portion of the plate 1.

A housing 2, which is generally called an arc chamber, is provided at an upper portion of the plate 1. The contact part includes a fixed contact 3 fixed to an upper surface of the housing 2 and a movable contact 4 moved to be brought into contact with the fixed contact 3 or separated therefrom according to an operation of actuator. The arc extinguishing part may be provided in the housing 2 and charged with an arc-extinguishing gas, and the like.

The actuator, which operates using the principle of electromagnet, includes a fixed core 5, a movable core 6, a movable shaft 7, and a return spring 8. A cylinder surrounds the fixed core 5 and the movable core 6. The cylinder 9 and the housing 2 form a closed space.

A coil (not shown) is provided near the cylinder 9 to generate an electromagnetic force on the periphery when power is applied. The fixed core 5 is magnetized by an electromagnetic force generated in the coil, and the movable core 6 is sucked by a magnetic force of the fixed core 5. Accordingly, the movable shaft 7 coupled to the movable core 6 and the movable contact 4 coupled to the upper portion of the movable shaft 7 move together and the movable contact 4 may be brought into contact with the fixed contact 3, so that the circuit is energized. The return spring 8 provides an elastic force allowing the movable core 6 to return to an initial position when the coil is powered off.

When a fault current occurs to cause the circuit to be broken so the movable contact 4 is separated from the fixed contact 3, an arc is generated at the contact part, and here, in order to extinguish the arc, the periphery of the contact is maintained to be airtight and filled with an insulating gas such as hydrogen $H_2$ or nitrogen $N_2$.

The housing 2, the plate 1, and the cylinder 9 are sealed so that the arc-extinguishing gas may not be leaked. For example, after the arc-extinguishing gas is injected into the housing 2, the cylinder 9 is welded to the plate 1 by a laser so as to be sealed.

However, since the housing 2, the plate 1, and the cylinder 9 are hermetically sealed, a state of the internal components, particularly, the contact part, cannot be known.

Therefore, a component which may determine and monitor the state of the contact part is required.

SUMMARY OF THE INVENTION

Therefore, an aspect of the detailed description is to provide a DC relay including an auxiliary contact to provide a monitoring function capable of recognizing an operating state of a contact part.

To achieve these and other advantages and in accordance with the purpose of this specification, as embodied and broadly described herein, a DC relay having an auxiliary contact including: a housing; main contacts installed at a portion of the housing; and an auxiliary contact installed at another portion of the housing, wherein a partition is installed in a longitudinal direction inside the housing to provide a first accommodating part and a second accommodating part, the main contacts are installed in the first accommodating part, and the auxiliary contact is installed in the second accommodating part.

The main contacts may include a fixed contact installed in a penetrating manner on an upper surface of the first accommodating part and a movable contact movably installed in the first accommodating part and brought into contact with the fixed contact or separated therefrom.

The partition may be integrally formed in the housing or detachably attached to the housing.

An accommodating part lower cover covering a lower portion of the first accommodating part may be provided.

The DC relay may further include: an auxiliary contact mounting bracket provided in the second accommodating part.

The DC relay may further include: a switch cooperatively operating according to an operational state of the main contacts and transferring a corresponding signal to the auxiliary contact.

The switch may be installed at a protrusion formed at a portion of the auxiliary contact mounting bracket.

An auxiliary contact printed circuit board may be installed on an upper surface of the auxiliary contact mounting bracket.

A switch terminal hole, to which a terminal of the switch is connected, may be formed at one portion of the auxiliary contact printed circuit board, and an auxiliary contact connecting portion connected to the auxiliary contact may be provided at another portion of the auxiliary contact printed circuit board.

The DC relay may further include: a driving shaft providing a driving force to the movable contact and an upper support plate and a lower support plate supporting the movable contact and the driving shaft.

The DC relay may further include: a lever protruding from a portion of the lower support plate and operating the switch.

The partition and the accommodating part lower cover may have a power transmission recess and a cutout portion, respectively, so that the lever is operable.

An external cable transmitting a signal from the auxiliary contact to the outside may be connected to the auxiliary contact.

An external cable mold allowing the external cable to be installed therein may be provided at an upper portion of the housing.

According to the DC relay having the auxiliary contact according to the embodiment of the present disclosure, the auxiliary contact is provided to transmit an operational state of the main contacts to the outside. Thus, it is possible to monitor a state of the main contact and perform an associated operation according to an operation of the main contact.

The auxiliary contact and the accessory device are separated from the main contact part by the partition formed in the housing. That is, the auxiliary contact printed circuit board and the switch are installed in the accommodating space separately provided in the housing, without affecting the arc-extinguishing function of the contact part. Also, the auxiliary contact printed circuit board and the switch are not damaged by an arc that occurs when the circuit is broken.

Since the auxiliary contact mounting part for installing the auxiliary contact printed circuit board and the switch is provided, the auxiliary contact printed circuit board and the switch may be easily installed.

Also, since the external cable mold for installing the terminal cable for transmitting a signal of the auxiliary contact to the outside is provided at the upper portion of the housing, the terminal cable may be easily installed.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIG. 4 and FIG. 5 are internal views of an arc chamber of a DC relay according to an embodiment of the present disclosure, in which FIG. 4 is a front view and FIG. 5 is a right side view.

DETAILED DESCRIPTION OF THE INVENTION

Hereinafter, embodiments of the present disclosure will be described in detail with reference to the accompanying drawings so that a person skilled in the art to which the present invention pertains to easily implement the invention, but the present invention is not limited thereto.

Figure 1:
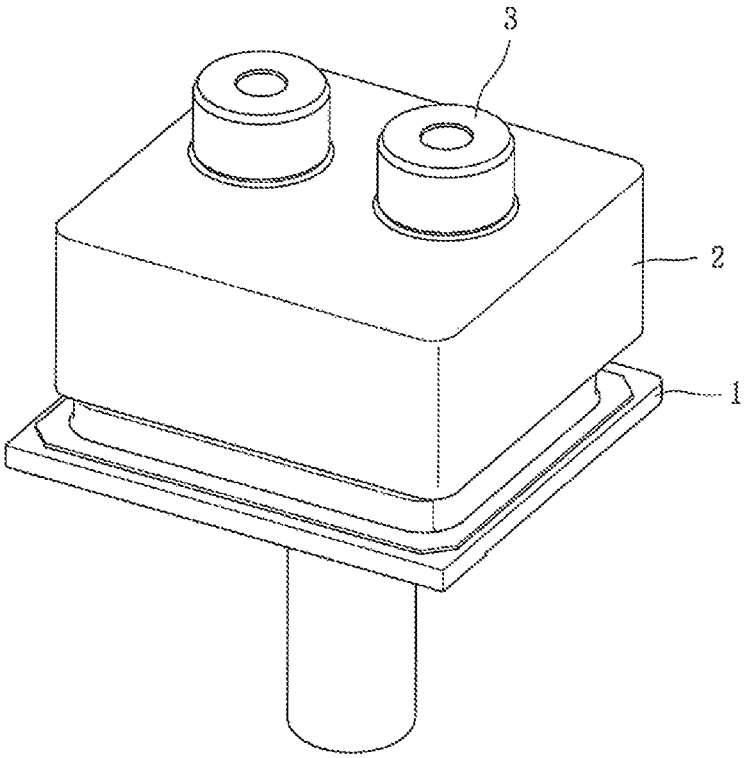
Fig. 1 Prior Art
FIGS. 1 and 2 are a perspective view and an internal structural view of a DC relay according to the related art.
Figure 2:
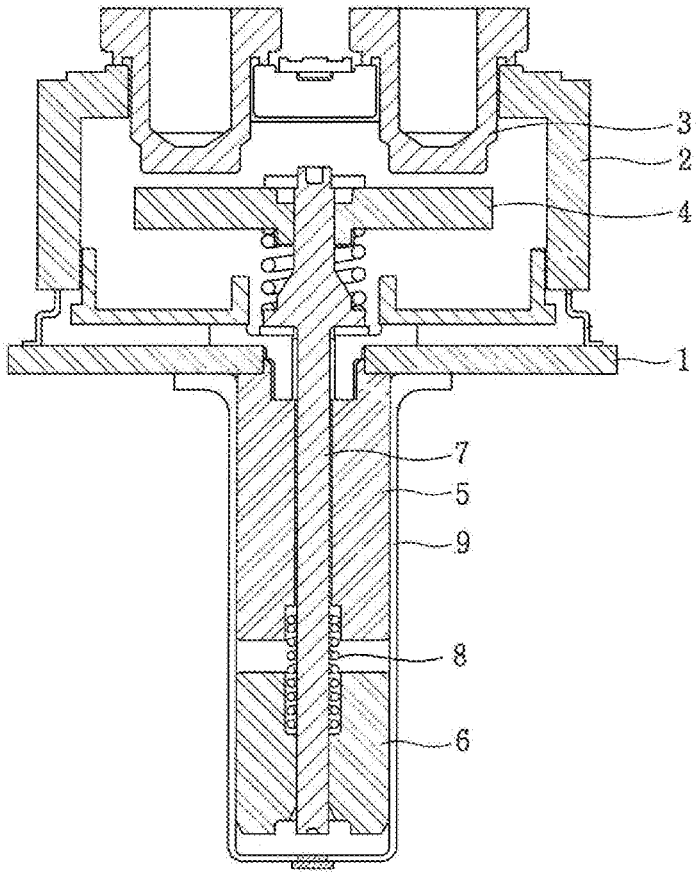
Fig. 2 Prior Art
Figure 3:
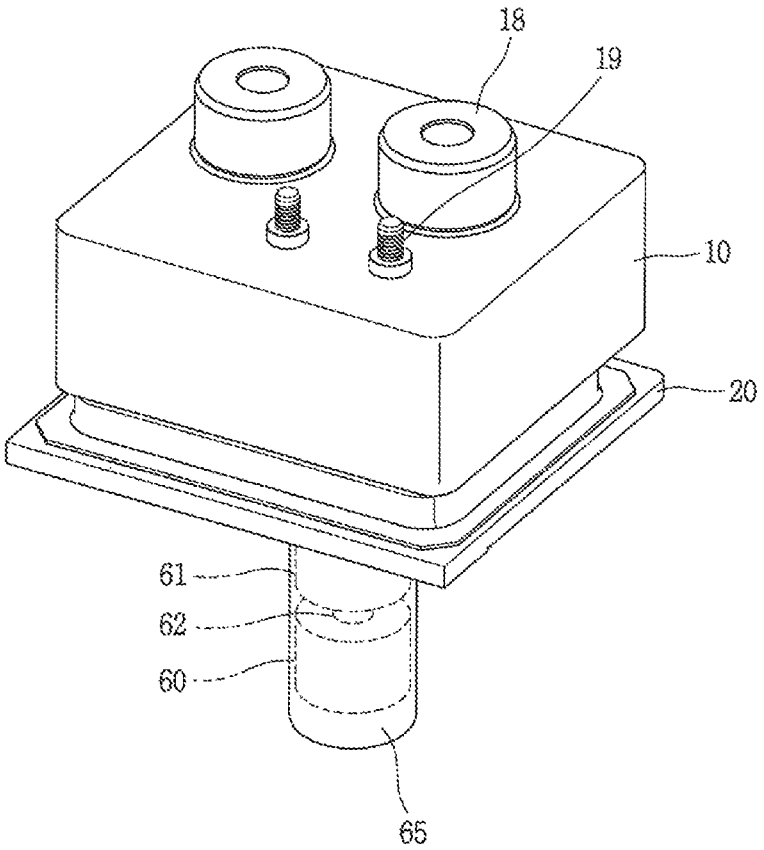
FIG. 3 is a perspective view of a DC relay according to an embodiment of the present disclosure, in which portions of a case and an actuator are removed.
Figure 4:
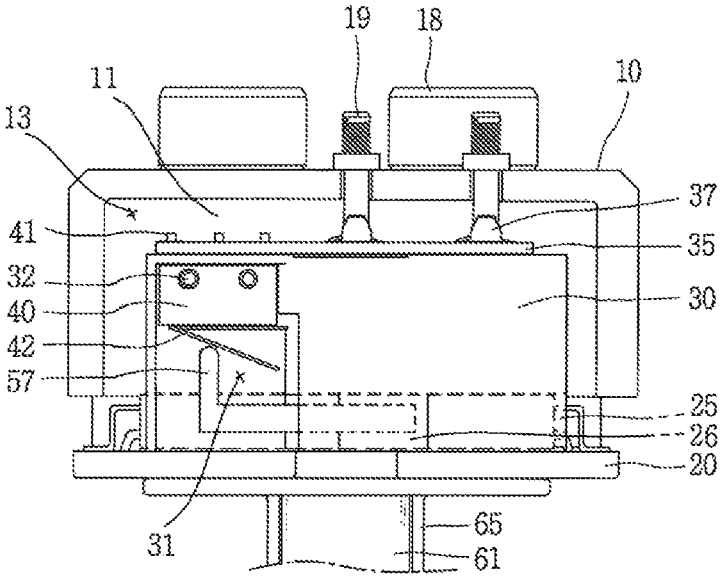
Figure 5:
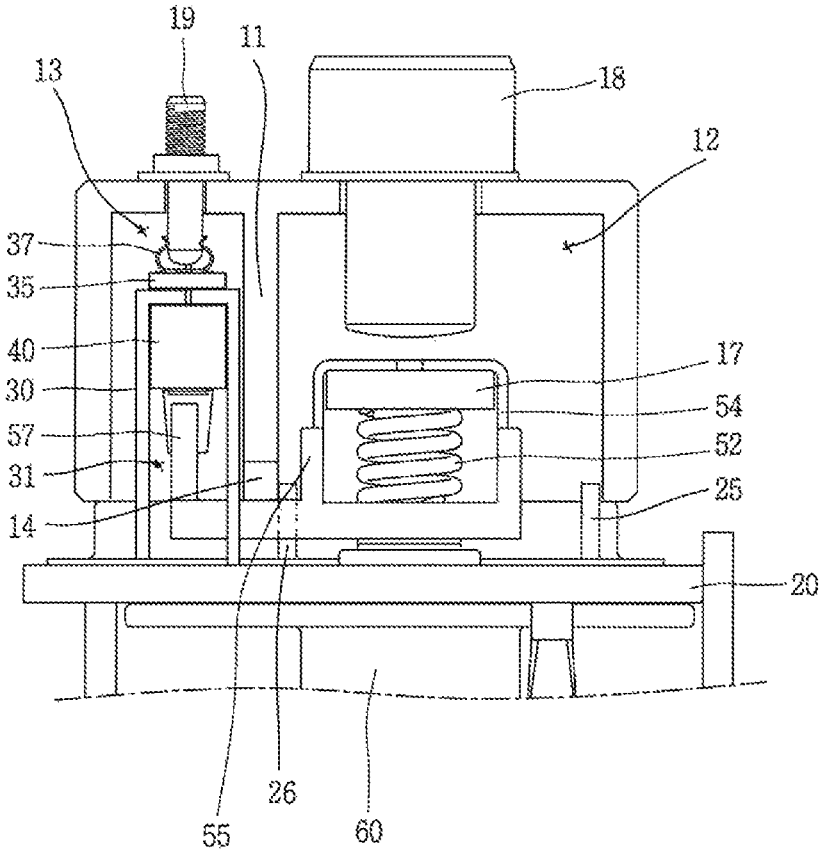
Figure 6:
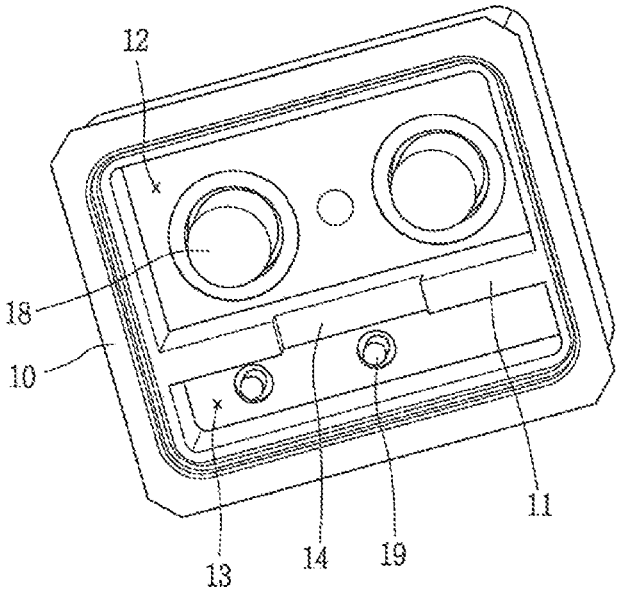
FIG. 6 is a bottom perspective view of an arc chamber applied to a DC relay according to an embodiment of the present disclosure.
Figure 7:
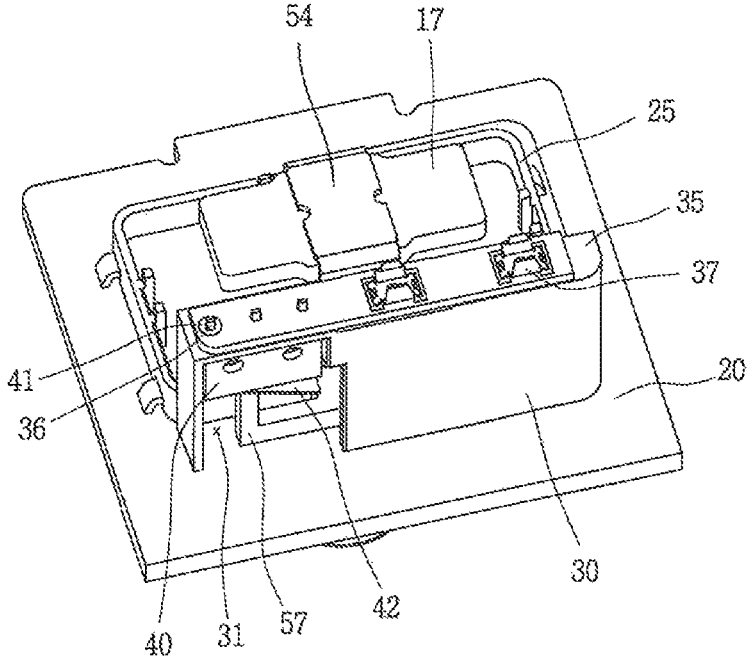
FIG. 7 is a perspective view illustrating a state in which an arc chamber is removed in FIG. 3.
Figure 8:
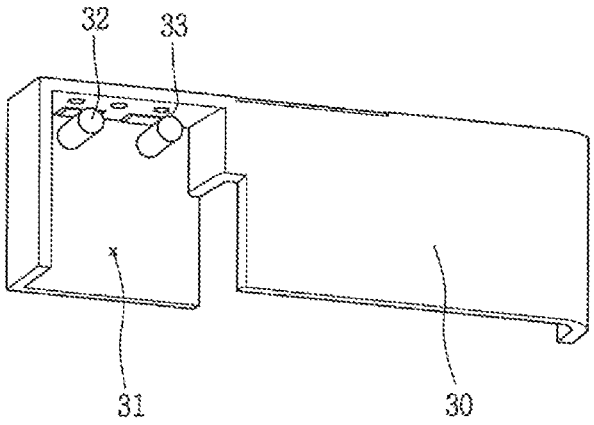
FIGS. 8 to 10 are perspective views of a mounting bracket, a driving shaft assembly, and an external cable mold applied to a DC relay according to an embodiment of the present disclosure.

FIGS. 1 and 2 are a perspective view and an internal structural view of a DC relay according to the related art, FIG. 3 is a perspective view of a DC relay according to an embodiment of the present disclosure, FIG. 4 and FIG. 5 are internal views of an arc chamber of a DC relay according to an embodiment of the present disclosure, FIG. 6 is a bottom perspective view of an arc chamber applied to a DC relay according to an embodiment of the present disclosure, FIG. 7 is a perspective view illustrating a state in which an arc chamber is removed in FIG. 3, and FIGS. 8 to 10 are perspective views of a mounting bracket, a driving shaft assembly, and an external cable mold applied to a DC relay according to an embodiment of the present disclosure. The DC relay according to embodiments of the present disclosure will be described in detail with reference to the drawings.

A DC relay having an auxiliary contact according to an embodiment of the present disclosure includes a housing 10; main contacts 17 and 18 provided at one portion of the housing 10; an auxiliary contact 19 provided at another portion of the housing 10; and an auxiliary contact mounting bracket 30 for an auxiliary contact (or an auxiliary contact mounting bracket) provided in the housing 10, wherein a partition 11 is provided in the housing 10 in a longitudinal direction to form a first accommodating part 12 and a second accommodating part 13, the main contacts 17 and 18 are installed at the first accommodating part 12 and the auxiliary contact auxiliary contact mounting bracket 30 is installed at the second accommodating part 13.

The housing 10 is provided for installing and arc extinguishing of the main contacts 17 and 18. The housing 10 is provided to extinguish an arc that occurs when the main contacts 17 and 18 are broken.

The housing 10 is provided for extinguishing an arc generated when the main contacts 17 and 18 are disengaged (separated), and is also referred to as an arc chamber. The housing 10 may have a box shape in which a bottom surface is open. The housing 10 is formed of a material having excellent corrosion resistance and heat resistance, such as ceramics. In the housing 10, the main contacts 17 and 18 and the auxiliary contact 19 are provided. The main contacts 17 and 18 may include a fixed contact 18 and a movable contact 17 which is brought into contact with or separated from the fixed contact 18.

The housing 10 has a partition 11 formed therein. The partition 11 may be formed in a longitudinal direction inside the housing 10. The partition 11 may be formed in a length direction (wide direction) inside the housing 10. The partitions 11 may be formed of the same material as that of the housing 10. For example, the partition 11 may be formed of a ceramic material. The partition 11 may be integrally formed in the housing 10 or may be formed in a detachable manner.

The internal space of the housing 10 is divided into two spaces by the partition 11. The two spaces will be separately referred to as a first accommodating part 12 and a second accommodating part 13. In other words, the second accommodating part 13 is a main contact accommodating part and the second accommodating part 13 is an auxiliary contact accommodating part. The first accommodating part 12 and the second accommodating part 13 may be completely separated from each other and blocked from each other by the partition 11.

In the first accommodating part 12, the main contacts 17 and 18 are installed. The fixed contact 18 and the movable contact 17 are installed in the first accommodating part 12.

In the second accommodating part 13, the auxiliary contact 19 and a component for an auxiliary contact are installed. The auxiliary contact 19 is installed on the upper surface of the second accommodating part 13.

A power transmission recess 14 is formed at a lower portion of the partition 11. The power transmission recess 14 is a space in which a lever 57 is operable.

The fixed contact 18 is installed in a penetrating manner at a portion of an upper surface of the housing 10. The fixed contact 18 is provided on the upper surface of the first accommodating part 12. The fixed contact 18 may be provided as a pair formed to be parallel and spaced apart from each other. An upper end portion of the fixed contact 18 may be connected to an external load and a lower end portion of the fixed contact 18 may be connected to the movable contact 17.

The movable contact 17 is installed inside the housing 10. The movable contact 17 is provided in the first accommodating part 12. The movable contact 17 is coupled to a driving shaft 50 and moves up and down to be brought into contact with or separate from the fixed contact 18.

An auxiliary contact 19 is installed in a penetrating manner at the other portion of the upper surface of the upper surface of the housing 10. The auxiliary contact 19 is provided on the upper surface of the second accommodating part 13. The auxiliary contact 19 may be provided as a pair installed to be parallel and spaced apart from each other. An upper end portion of the auxiliary contact 19 may be connected to the outside and a lower end portion of the auxiliary contact 19 may be connected to a switch 40 via a circuit board 35 for an auxiliary contact.

The auxiliary contact 19 operates according to a state of the main contacts 17 and 18. That is, the auxiliary contact 19 transfers a signal according to an operation of the main contacts 17 and 18 transmitted by the switch 40. When the main contacts 17 and 18 are turned on, the auxiliary contact 19 may operate in a forward direction (forward signal transmission) to perform an ON operation, or when the main contacts 17 and 18 are turned on, the auxiliary contacts 17 and 18 may operate in a reverse direction (reverse signal transmission) to perform an OFF operation.

A middle plate 20 is formed as a flat plate. The middle plate 20 serves to divide an actuator and a contact part. The actuator is installed below the middle plate 20. On an upper side of the middle plate 20, a lower support plate 55 is provided and the main contacts 17 and 18 and the auxiliary contact 19 are installed. In addition, an arc-extinguishing part is provided on the upper side of the middle plate 20. The -extinguishing part may be configured as an internal portion of the lower support plate 55. A hole is formed at the center of the middle plate 20 so that the driving shaft 50 may move up and down. The middle plate 20 supports some components of the housing 10 and the actuator.

An accommodating part lower cover 25 is provided at an upper portion of the middle plate 20. The accommodating part lower cover 25 is coupled to a lower portion of the first accommodating part 12. The accommodating part lower cover 25 serves to close the lower portion of the first accommodating part 12 to close the main contact part. A hole is formed at the center of the accommodating part lower cover 25 to allow the driving shaft 50 to move up and down. Also, a cutout portion 26 is formed on a front surface of the accommodating part lower cover 25 to provide a space allowing the lever 57 to operate.

A mounting bracket 30 for an auxiliary contact (or auxiliary contact mounting bracket 30) is provided on the upper side of the middle plate 20. The auxiliary contact mounting bracket 30 may be provided on a front surface of the accommodating part lower cover 25. The auxiliary contact mounting bracket 30 may be formed of synthetic resin. The auxiliary contact mounting bracket 30 is inserted into the second accommodating part 13. The auxiliary contact mounting bracket 30 may be formed in the shape of a box in which portions of a lower surface and a side surface thereof are open.

A working portion 31, space in which the lever 57 is operable, is provided at a portion of the auxiliary contact mounting bracket 30. The working portion 31 may be provided as a space formed as a recess in a portion of the auxiliary contact mounting bracket 30.

The auxiliary contact mounting bracket 30 may be provided with a protrusion 32 on which the switch 40 may be installed. The protrusion 32 may be provided at a portion of the working portion 31.

A switch terminal hole 33 through which a switch terminal 41 of the switch 40 may pass may be formed on an upper surface of the auxiliary contact mounting bracket 30. The switch terminal hole 33 may be formed on an upper surface of the working portion 31.

A circuit board 35 for an auxiliary contact (or auxiliary contact circuit board 35) may be provided on the upper surface of the auxiliary contact mounting bracket 30.

The auxiliary contact mounting bracket 30 is provided at the second accommodating part 13. That is, when the housing 10 is coupled to the middle plate 20, the auxiliary contact mounting bracket 30 is inserted into the second accommodating part 13.

The switch 40 cooperatively operates according to an operational state of the main contacts 17 and 18. The switch 40 may transmit an ON/OFF state of the main contacts 17 and 18. The switch 40 may be provided as a microswitch. In this case, the terminal is not exposed and a possibility of causing an accident due to spark occurrence may be reduced. An operational state of the DC relay is transferred to the outside via the switch 40. The switch 40 includes a switch lever 42.

A printed circuit board 35 for an auxiliary contact (or an auxiliary contact printed circuit board 35) is provided on an upper surface of the auxiliary contact mounting bracket 30. A switch terminal hole 36 is provided at a portion of the circuit board 35 for the auxiliary contact. The switch terminal hole 36 of the auxiliary contact printed circuit board 35 communicates with the switch terminal hole 33 of the auxiliary contact mounting bracket 30.

An auxiliary contact connecting portion 37 is provided at the other end portion of the auxiliary contact printed circuit board 35. The auxiliary contact connecting portion 37 may be configured as a contact fastening member or a fitting member such as a clamp. The auxiliary contact connecting portion 37 is connected to a lower end portion of the auxiliary contact 19.

The auxiliary contact printed circuit board 35 may have a circuit or a controller for connecting the switch 40 and the auxiliary contact 19. In this circuit or controller, an operation direction (signal transmission direction) of the auxiliary contact 19 may be set according to a state of the main contacts 17 and 18.

The auxiliary contact connecting portion 37 connects the auxiliary contact 19 and the switch 40. The auxiliary contact connection portion 37 is connected to a lower end portion of the auxiliary contact 19. Further, the auxiliary contact connecting portion 37 is connected to the switch terminal 41.

Figure 9:
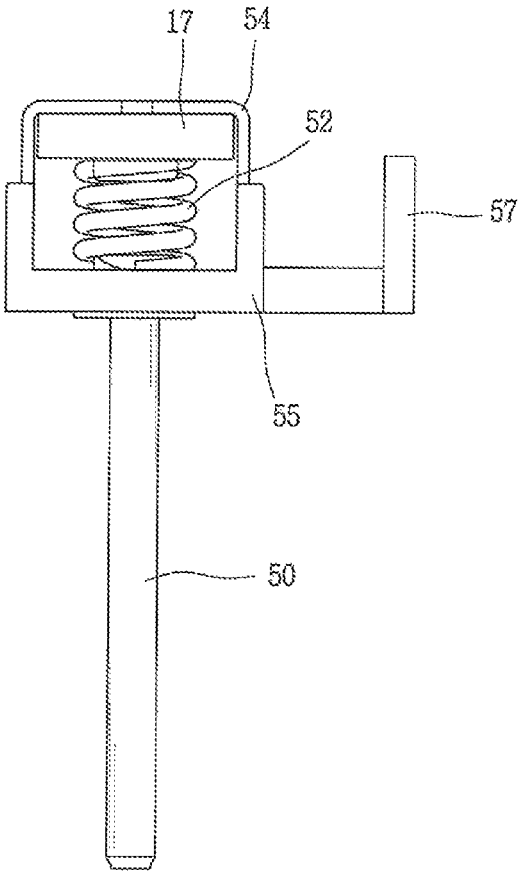

A driving shaft assembly illustrated in FIG. 9 includes the driving shaft 50, the movable contact 17, an upper support plate 54, a lower support plate 55, a contact spring 52, and the lever 57.

The movable contact 17 is coupled to an upper portion of the driving shaft 50. Here, the contact spring 52 is interposed between the movable contact 17 and the driving shaft 50. A driving force of the driving shaft 50 is transferred to the movable contact 17 through the contact spring 52.

The upper support plate 54 is provided on the upper surface of the movable contact 17. The upper support plate 54 supports the movable contact 17 at the upper portion of the movable contact 17 so as to prevent the movable contact 17 from being released and restricts movement of the movable contact 17. The upper support plate 54 has a 'C' shape and may be coupled to the movable contact 17 to cover the movable contact 17 from above.

The lower support plate 55 is provided below the contact spring 52. The lower support plate 55 may be coupled to the upper support plate 54. The upper support plate 54 and the lower support plate 55 may be coupled to the driving shaft 50 to move integrally.

The lever 57 is provided on one side of the lower support plate 55. The lever 57 is formed as a portion protrudes or extends from the lower support plate 55. The lever 57 may be formed integrally with the lower support plate 55. An end portion of the lever 57 is connected to the switch lever 42 of the switch 40. The lever 57 may be bent.

The driving shaft assembly may be moved integrally. That is, when the driving shaft 50 is lifted, the movable contact 17 is lifted to be coupled to the fixed contact 18, and the lever 57 is lifted to raise the switch lever 42 to operate the switch 40. An electric signal is transmitted to the auxiliary contact 19 according to an operation of the switch 40 and a signal of the auxiliary contact 19 is transmitted to the outside.

A movable core 60 is coupled to a lower portion of the driving shaft 50. The movable core 60 is attracted in accordance with a magnetic force of a fixed core 61 so as to be moved upwards. When the magnetic force of the fixed core 61 is released, the movable core 60 returns to its original position by an operation of a return spring 62. The driving shaft 50 moves together with the movable core 60.

A cylinder 65 is coupled to a lower portion of the middle plate 20. The driving shaft 50, the fixed core 61, the movable core 60, and the like, are inserted into the cylinder 65 to form an airtight space at the lower portion of the middle plate 20. The cylinder 65 is preferably welded to the lower portion of the middle plate 20 to ensure airtightness. According to the laser welding method, the work process is easy and airtightness is improved. The cylinder 65 also serves to guide upward movement of the driving shaft 50 when the movable core 60 and the driving shaft 50 coupled to the movable core 60 are moved upwards by an electromagnetic force of a coil (not shown).

The housing 10, the center hole of the middle plate 20, and the cylinder 65 form a closed airtight space, and the airtight space is filled with an insulating gas and sealed.

Figure 10:
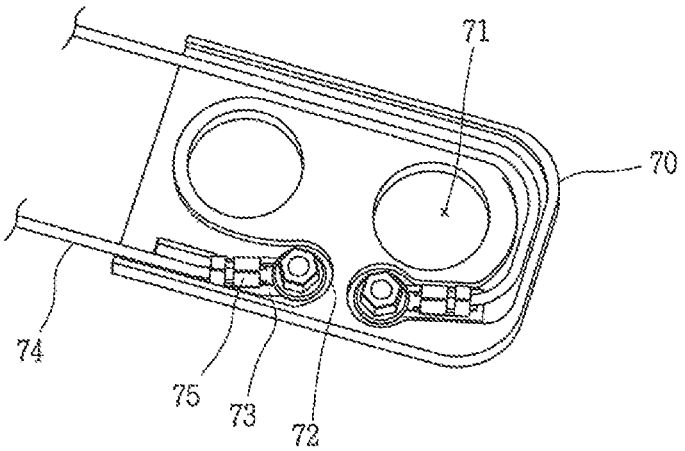

An external cable mold 70 is illustrated in FIG. 10. The external cable mold 70 is coupled to an upper portion of the housing 10. The external cable mold 70 is installed between a case (not shown) and a lower support plate 55. The external cable mold 70 has a through hole 71 through which the fixed contact 18 may be inserted. Further, an accommodating recess 72 in which a terminal cable 74 may be disposed is formed along the periphery. An auxiliary contact terminal hole 73 is formed at an end portion of the accommodating recess 72 so that the auxiliary contact 19 is connected. A terminal of the terminal cable 74 and the auxiliary contact 19 may be connected through the auxiliary contact terminal hole 73. A signal of the auxiliary contact 19 may be transferred to the outside through the terminal cable 74. The terminal cable 74 for transferring the signal of the auxiliary contact 19 to the outside may be easily installed by the external cable mold 70.

According to the DC relay having the auxiliary contact according to the embodiment of the present disclosure, the auxiliary contact is provided to transmit an operational state of the main contacts to the outside. Thus, it is possible to monitor a state of the main contacts and perform an associated operation according to an operation of the main contacts.

The auxiliary contact and the accessory device are separated from the main contact part by the partition formed in the housing. That is, the auxiliary contact printed circuit board and the switch are installed in the accommodating space separately provided in the housing, without affecting the arc-extinguishing function of the contact part. Also, the auxiliary contact printed circuit board and the switch are not damaged by an arc that occurs when the circuit is broken.

Since the auxiliary contact mounting part for installing the auxiliary contact printed circuit board and the switch is provided, the auxiliary contact printed circuit board and the switch may be easily installed.

Also, since the external cable mold for installing the terminal cable for transmitting a signal of the auxiliary contact to the outside is provided at the upper portion of the housing, the terminal cable may be easily installed.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A DC relay having an auxiliary contact, the DC relay comprising:

a housing;

main contacts installed at a portion of the housing; and an auxiliary contact installed at another portion of the housing, wherein a partition is installed in a longitudinal direction inside the housing to provide a first accommodating part and a second accommodating part, the main contacts are installed in the first accommodating part, and the auxiliary contact is installed in the second accommodating part;

an auxiliary contact mounting bracket provided in the second accommodating part; and a switch cooperatively operating according to an operational state of the main contacts and transferring a corresponding signal to the auxiliary contact, wherein a working portion in which the switch is installed and operable, is provided at a portion of the auxiliary contact mounting bracket, wherein an auxiliary contact printed circuit board is installed on an upper surface of the auxiliary contact mounting bracket, and the auxiliary contact is connected to the switch through the auxiliary contact printed circuit board.

2. The DC relay of claim 1, wherein the main contacts include a fixed contact installed in a penetrating manner on an upper surface of the first accommodating part and a movable contact movably installed in the first accommodating part and brought into contact with the fixed contact or separated therefrom.

3. The DC relay of claim 2, wherein an accommodating part lower cover covering a lower portion of the first accommodating part is provided.

4. The DC relay of claim 1, wherein the partition is integrally formed in the housing or detachably attached to the housing.

5. The DC relay of claim 1, wherein the switch is installed at a protrusion formed at a portion of the auxiliary contact mounting bracket.

6. The DC relay of claim 1, wherein an external cable transmitting a signal from the auxiliary contact to the outside is connected to the auxiliary contact.

7. The DC relay of claim 6, wherein an external cable mold allowing the external cable to be installed therein is provided at an upper portion of the housing.

8. The DC relay of claim 1, wherein an opening connected to the working portion is provided in the auxiliary contact mounting bracket.

* * * * *